US005558356A

United States Patent [19]

Challande et al.

[11] Patent Number: 5,558,356

[45] Date of Patent: Sep. 24, 1996

[54] BINDING ELEMENT FOR ALPINE SKIS

[75] Inventors: Christian Challande, Cruseilles; Pascal Thomas, Chambery; Pierre Desarmaux, Evires, all of France

[73] Assignee: Salomon S.A., Metz-Tessy, France

[21] Appl. No.: 288,753

[22] Filed: Aug. 11, 1994

[30] Foreign Application Priority Data

Aug. 18, 1993 [FR] France ..... 93 10190

[51] Int. Cl.[6] ..... A63C 9/085

[52] U.S. Cl. ..... 280/625; 280/629; 280/634

[58] Field of Search ..... 280/613, 623, 280/625, 626, 628, 629, 631, 632, 635, 636, 630, 634

[56] References Cited

U.S. PATENT DOCUMENTS

| | | | |
|---|---|---|---|
| 4,336,956 | 6/1982 | Richert et al. | 280/625 |
| 4,516,792 | 5/1985 | Scheck et al. | 280/625 |
| 4,561,673 | 12/1985 | Pascal et al. | 280/629 |
| 4,984,816 | 1/1991 | Rullier | 280/625 |
| 5,040,821 | 8/1991 | Berthet et al. | 280/625 |
| 5,044,658 | 9/1991 | Challande et al. | 280/631 |
| 5,303,950 | 4/1994 | Rigal et al. | 280/636 |

FOREIGN PATENT DOCUMENTS

| | | | |
|---|---|---|---|
| 0102868 | 3/1984 | European Pat. Off. | A63C 9/085 |
| 2537442 | 6/1984 | France | A63C 9/085 |
| 2624386 | 6/1989 | France | A63C 9/08 |
| 2624752 | 6/1989 | France | 280/634 |
| 3230187 | 2/1984 | Germany | A63C 9/085 |
| 3335878 | 4/1984 | Germany . | |
| 664699 | 3/1988 | Switzerland | A63C 9/08 |

OTHER PUBLICATIONS

English language (Derwent) abstracts for (1) DE 3335878, (2) DE 2905837, (3) FR 2640516.

*Primary Examiner*—Richard M. Camby
*Assistant Examiner*—Frank Vanaman
*Attorney, Agent, or Firm*—Greenblum & Bernstein P.L.C.

[57] ABSTRACT

The invention is related to a binding element for alpine skis including the following components: a base, a body, a jaw for retaining the boot and an energy spring housed in the body. The binding element includes the following features: the support plate is movable in a rocking motion and the linking means, sensitive to the rocking motions of the support plate, connect the support plate to at least one of the movable members of the binding element, to reduce the resistance force that the boot must overcome to be laterally released by the jaw, and then generate the free tilting of the jaw beyond a rocking motion with a predetermined amplitude obtained by the support plate.

12 Claims, 3 Drawing Sheets

BINDING ELEMENT FOR ALPINE SKIS

BACKGROUND OF THE INVENTION

1. Field of the Invention

The invention is related to a binding element for alpine skis, intended to retain a boot in support on a ski, and to release the latter in case of an excessive force. More specifically, the invention is related to a front binding element.

2. Discussion of Background and Material Information

It is known to retain a boot in support on a ski by means of a front binding element and a rear binding element. Each retention element has a jaw borne by a body which is movable against the return force exerted by an energy spring, generally a compression spring.

Usually, the front binding element reacts to a lateral force of the front end of the boot. Such a force originates from a pure torsional bias on the skier's leg.

Certain binding elements also react to an upward vertical force. Such a force corresponds to a backward fall of the skier. The European Patent Application No. 102 868, for example, describes such a binding.

Other bindings have a compensation mechanism that reacts in the case of a torsional bias combined with a forward fall of the skier. Such a mechanism is described, for example, in German Patent Application No. 29 05 837. This mechanism comprises a vertically movable boot support plate whose movement, generated by a downward vertical pressure of the boot, reduces the return force that the spring exerts on the jaw.

Another mechanism is described in German Patent Application No. 33 35 878. This mechanism also comprises a vertically mobile support plate which forces the jaw to be displaced in the direction of the release of the boot. Such devices compensate for the increased friction from the boot on its supports induced by the frontward component of the fall. Such mechanisms are satisfactory as long as the lateral component of the fall remains preponderant with respect to the vertical component.

It happens that in the case of certain so-called "front-torsion" falls, i.e., with a forward component and a lateral component, the lateral component is not sufficient to generate lateral tilting of the jaw. A twisting of the boot then occurs, which boot becomes wedged between the jaw and its support plate. Currently known compensation mechanisms are not sufficiently active to generate an opening of the jaw. Sometimes these falls are dangerous and cause injuries, in particular in the area of the skier's knees.

SUMMARY OF THE INVENTION

One of the objects of the invention is to propose a binding element which releases the boot especially in the case of a front-torsion fall where the lateral component is relatively low.

Another object of the invention is to propose a binding element that is relatively simple to construct.

Other objects and advantages of the invention will become apparent upon reading the following description, this description, however, being provided as a non-limiting example.

In accordance with the invention, the binding element for alpine skis comprises the following members:

a base connected to the ski;

a body mounted on the base;

a boot retention jaw borne by the body;

the jaw comprising two lateral boot retention wings and a vertically retaining sole clamp;

an energy spring housed in the body to elastically oppose the opening movement of the jaw in response to forces exerted by the boot;

a support plate upon which the sole of the boot rests.

According to the invention, the support plate is movable in a rocking motion and linking means, sensitive to the rocking motions of the support plate, connect the support plate to at least one of the movable members of the binding element to reduce the resistance force that the boot must overcome in order to be released laterally by the jaw, and then generate free pivoting of the jaw, beyond a pivoting motion with a predetermined amplitude obtained by the support plate.

BRIEF DESCRIPTION OF THE DRAWINGS

The invention will be better understood with reference to the description below and the annexed drawings which form an integral portion thereof.

DETAILED DESCRIPTION OF THE PREFERRED EMBODIMENTS

Figure 1:
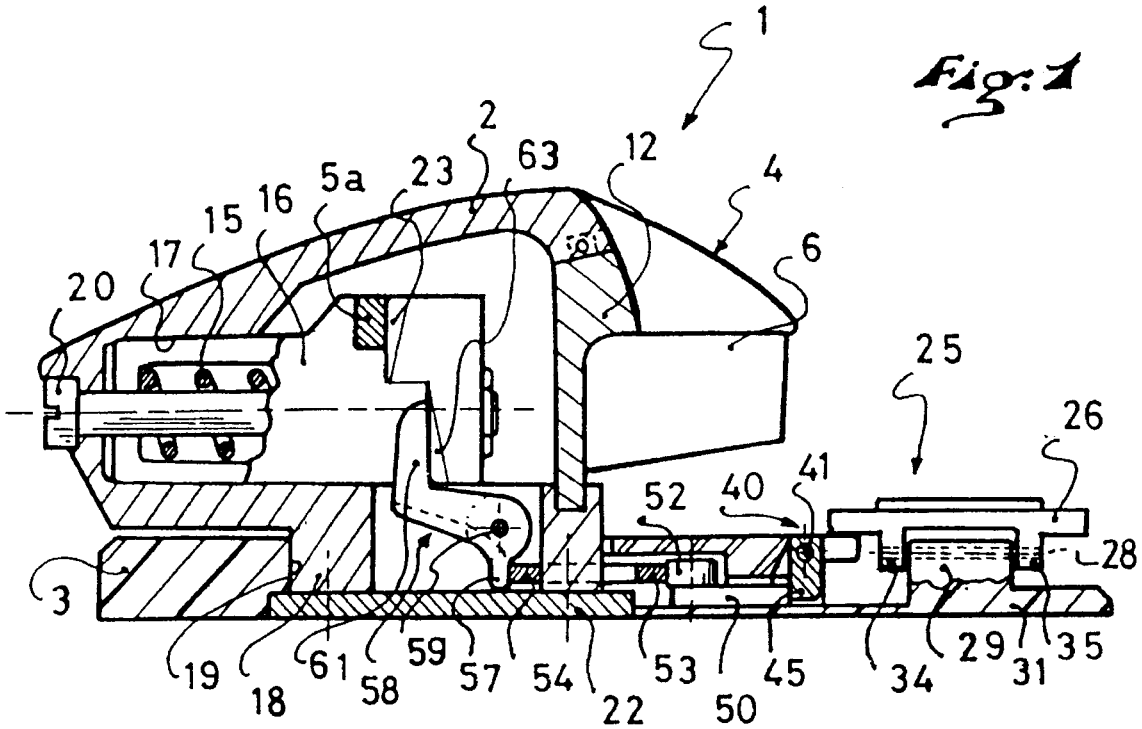
FIG. 1 represents a side elevation and sectional view of a binding element according to a non-limiting embodiment of the invention.

FIG. 1 shows a binding element 1 which, apart from the support device and the base which will be described in greater detail hereinafter, has a general structure known, for example, from French Patent Publication No. 2 640 516. However, only the members of this binding that are essential for understanding the present invention have been represented.

With reference to FIG. 1, binding element 1 comprises a body 2 connected to a base 3 which is connected to the ski by any appropriate means, for example, by screws.

Body 2 bears a jaw 4 for retaining the front end of the boot. Jaw 4 comprises two lateral retention wings 5 and 6, respectively journaled to body 2 about axes 7 and 8. Jaw 4 also comprises a vertically retaining sole clamp 12 of the boot.

Wings 5 and 6 are movable in response to forces exerted by the boot, against the return force applied thereto by a spring 15.

Spring 15 is housed in the body. It actuates a piston 16 also housed and guided in the body for a longitudinal translational movement. The figures show that the piston is housed and guided in a housing 17 of the body, and that the spring is engaged inside the piston. Its front end is in support against the bottom of the piston, located on the front side of the binding element. Furthermore, a screw 20, whose head is retained by the front of the body, crosses the piston and the spring, and has a nut 21 towards the rear which retains the rear end of the spring. A rotation of the screw drives the spring in translation, which enables adjustment of the initial compression of the spring.

Beyond their journal axles 7 and 8, wings 5 and 6 have a small arm 5*a*, 6*a*, which drives piston 16 rearwardly by taking support against a shoulder 23 located in the upper rear portion of piston 16.

Base 3, which bears the body, enables a rotation of the body about a vertical axis. As represented in FIG. 1, the body has a cylindrical vertical pivot 18, which crosses a cylindrical opening 19 with corresponding dimension displayed by the base, through which it is guided. The assembly is, for example, obtained by a disk 22 assembled to the pivot, for example, by screws. The disk has a diameter slightly greater than that of the pivot, it is housed in a shouldered recess of the base. The upstanding pivot 18 is hollow and has a central recess 24 which opens upwardly in the internal volume of the body, especially which is in communication with housing 17 of the piston.

A movable latch 54 retains the body in a position aligned with respect to the longitudinal axis defined by the base. This latch is described in further detail below.

Binding element 1 further comprises a support device 25 for the front end of the sole of the boot.

The support device has a support plate 26 on which the sole of the boot rests. Plate 26 can be equipped in its upper portion with any appropriate coating intended to facilitate lateral sliding of the boot, for example, a polytetrafluroethylene (PTFE) coating. It is approximately as wide as the ski in this area.

In accordance with the invention, support plate 26 on which the boot rests can oscillate for a pivoting or rocking motion on either side of a nominal position in which it provides the boot with a substantially horizontal support surface.

As per the illustrated embodiment, the support plate is journaled in rotation about a longitudinal axle 28 located towards the center of the width of the plate.

Axle 28 is borne by a pin/plug 29 which rises from a plate 31. Plate 31 extends beneath support plate 26, against the upper surface of the ski. For example, it is connected to base 3 which it extends rearwardly, or else it continuously extends base 3.

As for the support plate, it has two vertical lugs 34, 35 in front of and behind pin 29 which is crossed by the axis of pin or axle 28.

A linking means that reacts to the rocking motions of support plate 26 further connects the support device to the energy spring. This linking means exerts on the spring a force which reduces the return force that the spring itself exerts on the lateral retention wings. In the case of a rocking bias exerted on the support plate, the boot is released relatively more easily. This especially compensates for the friction and other effects which brake the lateral movement of the boot in case the latter twists in its retention jaw.

This means also actuates the latch 54 which retains the body aligned with respect to the base, so as to release the body in rotation with respect to the base beyond a predetermined displacement path/course of plate 26.

Figure 2:
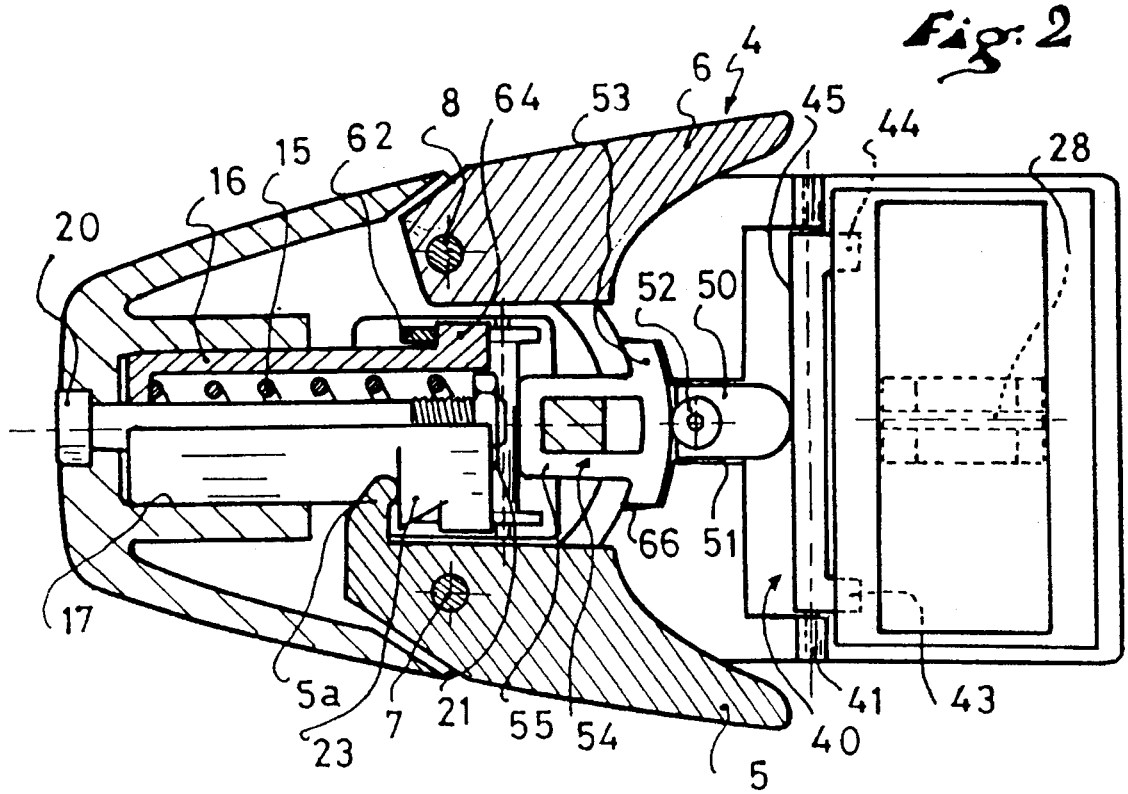
FIG. 2 represents two sectional half-views, in plan, in which: from the top, the sections are taken through planes located at different heights.
Figure 3:
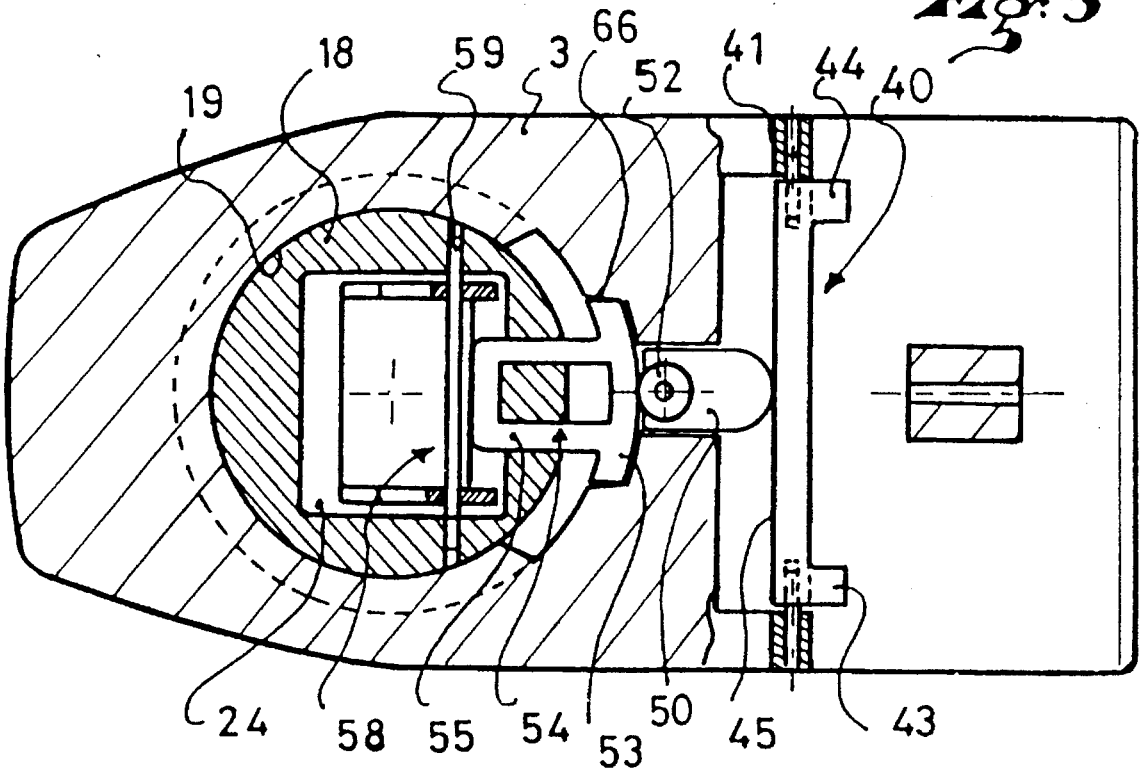
FIG. 3 is a top sectional plan view of the binding element of FIG. 1 in the area of its base.
Figure 4:
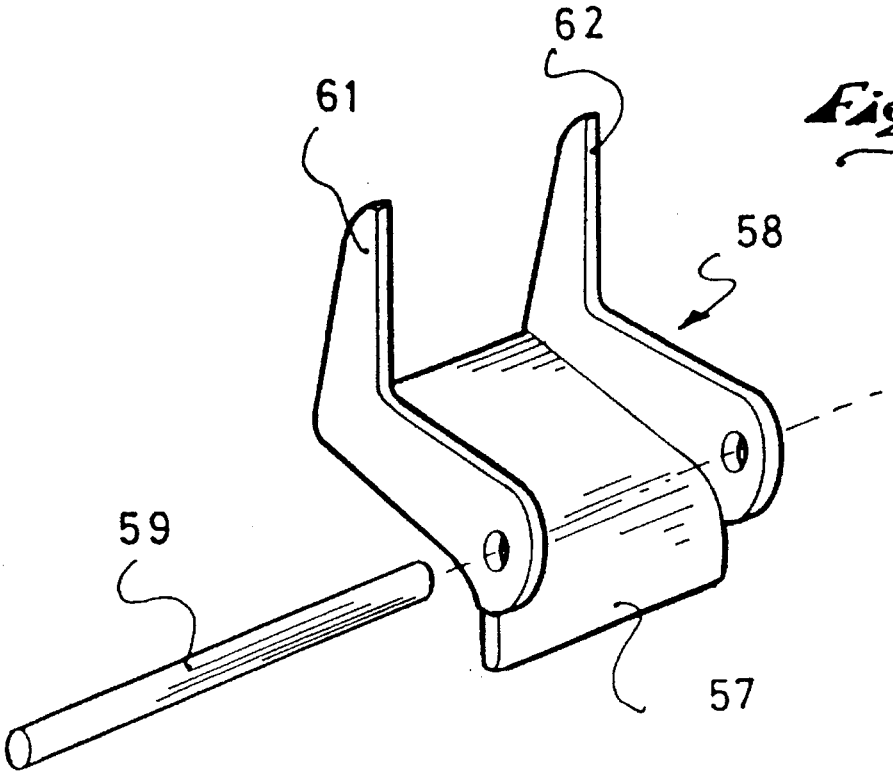
FIG. 4 is a perspective view of the rocking element.

With reference to FIGS. 1 and 2, a pivoting or tipping element 40 is journaled about a horizontal and transverse axle or pin 41 borne by plate 31 or, if necessary, base 3, and located just in front of support plate 26. Tipping element 40 extends substantially along the entire width of support plate 26. It has a horizontal arm oriented rearwardly and a vertical arm oriented downwardly with respect to axle 41. The horizontal arm comprises two lugs 43 and 44 which are respectively engaged beneath each a lateral edge portion of plate 26, such that the rocking motion of plate 26 on either side drives the horizontal arm of the tipping element in a downward rotation.

In addition, tipping element 40 has a vertical arm 45 which, at least in the vicinity of the median longitudinal axis of the binding element, provides a support surface on which a longitudinal pusher 50 rests, and to which it imparts its movement. Pusher at 50 is guided in a groove 51 of the base oriented along a longitudinal direction. Towards the front, pusher 50 bears a roller 52 which presses on incurved arm 53 of an anchor-shaped element 54 forming a latch. Body 55 of the anchor is borne and guided along the longitudinal direction defined by the body through the wall of pivot 18 which it crosses straight through.

Inside pivot 18, in recess 24, body 55 of anchor 54 is in support against vertical arm 57 of a pivotal or tipping element 58. Pivotal element 58 is partially housed in recess 24 of pivot 18, and is journaled about a transverse axis 59 borne by the recess wall. Towards the top, it has an approximately vertical arm constituted by two forks 61 and 62 which pass on each side of the front portion of piston 16, and which are each in front-to-rear support against a shoulder 63, 64, that the piston has in its rear portion. These shoulders are of the same type as shoulders 23 by means of which the lateral retention wings bias piston 16.

Anchor 54 further forms the removable latch that retains body 2 in the alignment of base 3. Arm 53 of the anchor is housed in a correspondingly shaped recess 66 sunk in the wall of guide opening 19 of pivot 18. The shape of recess 66 is determined so that arm 53 of anchor 54 is housed virtually without clearance for a rotational movement about the axis of the pivot, but so that anchor 54 can slide in longitudinal translation by the action of pusher 50.

The operation of the device described hereinabove is as follows.

In the case of a pure lateral fall, the boot biases either of wings 5, 6, which drive piston 16 rearwardly against the return force developed by the compression of the spring. Beyond a predetermined opening, the wing releases the boot, or, if the bias ceases in the meantime, brings the boot back in centered position on the ski.

If, during the fall, the boot undergoes a twisting motion, support plate 26 is biased in a rocking motion. Support plate 26 transmits this bias to tipping element 40, by either one of its lugs 43, 44, along the direction of the bias. Tipping element 40 actuates pusher 50, which in return pushes anchor 54 back towards the front. Anchor 54 drives tipping element 58, which then biases piston 16 rearwardly, i.e., in the same direction as wings 5 and 6. In the area of piston 16, the action of support plate 26 is added to that of the biased wing, so that the lateral force that the boot must overcome to open a wing and be released, is reduced. The increased friction induced by the twisting of the boot is compensated. Due to the dimensions of the various elements, and through the lever arms of the various tipping elements, it is possible to generate a more or less substantial compensation. This is known to one of ordinary skill in the art.

Figure 5:
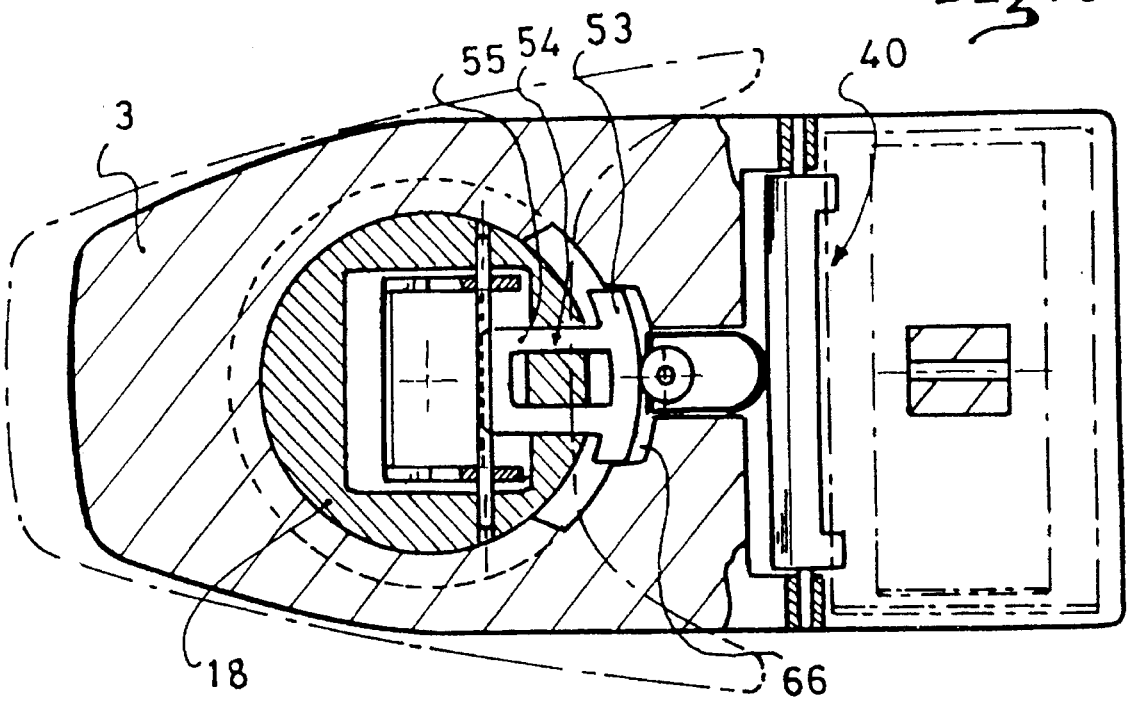
FIGS. 5 and 6 are views similar to FIG. 3, illustrating the operation of the device with FIG. 5 showing the latch being engaged with the binding undergoing a compensation action, and with FIG. 6 showing the latch being disengaged, thereby allowing the body of the binding to pivot freely.

This compensation action is illustrated in FIG. 5, and takes place as long as arm 53 of anchor 54 rests in its housing 66, i.e., as long as the rocking motion of support plate 26 rests on this side of a predetermined amplitude.

Figure 6:
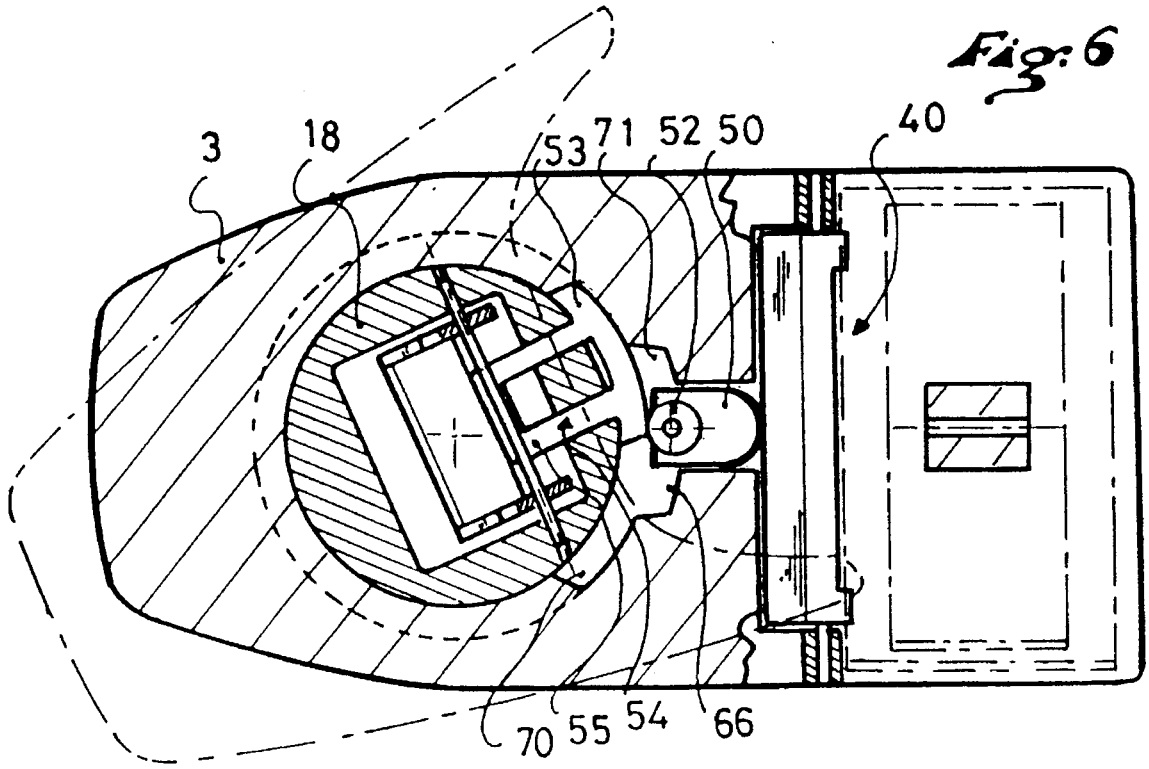

If this predetermined amplitude is attained or surpassed, arm 53 exits from its housing. The latch which retained the body no longer exists, and the body can pivot freely about its pivot 18, as is illustrated in FIG. 6. The boot is then released by the binding element virtually freely.

Preferably, this rotational movement is free along a limited angular amplitude, sufficient, however, to generate certain release of the boot.

During this movement, arm 53 of anchor 54 circulates in either of two clearances 70, 71 that recess 66 has on each side of its outlet in opening 19. The amplitude of the angular movement is determined according to the half-length of arm 53 and the length of these clearances, 70, 71. These two dimensions are preferably close so that roller 52 rests in support against arm 53 during this movement.

After release of the boot, the piston develops on pivotal element 58 a return force which tends to bring the various elements of the linking means and support plate 26 back to their respective initial position.

If necessary, the contact surface between arm 53 of anchor 55 and the wall of clearances 70, 71, can be arranged to create a ramp effect which facilitates the return of body 2 in a position aligned with respect to base 3.

The present description is only provided as an example, and one could adopt other embodiments of the invention without departing from the scope thereof. In particular, one could modify the nature of the means which creates a compensation, and the nature of the removable latch. One could also modify the internal nature of the binding element and adapt the linking means thereto. In this regard, it is understood that the invention applies similarly to binding elements for which the energy spring is biased by a tie-rod instead of a piston, or any other support means.

In addition, one could control pivotal element 58 and latch 54 from support plate 26 by means of two independent circuits.

An adjustment along the circuit of the latch would additionally allow to control the moment where unlatching of the body occurs, i.e., to have a more or less easy unlatching.

The instant application is based upon French patent application 93.10190 of Aug. 18, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A binding for retaining a boot on an alpine ski, said binding comprising:

a base for attachment to a ski;

a body mounted on said base;

means for mounting said body for free rotation about an upward extending axis with respect to said base;

a latch movable between a latched position and an unlatched position, said body being retained against said free rotation in said latched position of said latch;

a retention jaw borne by said body, said retention jaw comprising two laterally opposed retention wings which laterally retains the boot and a sole clamp which vertically retains the boot;

a spring housed in said body which elastically opposes release movements of said jaw in response to forces transmitted by the boot;

a support plate for supporting a sole of the boot;

means for defining a rocking motion of said support plate about a predetermined longitudinal axis fixed relative to the ski said longitudinal axis being parallel to a longitudinal direction of the ski; and a linking device operatively connecting said support plate to said spring, said linking device comprises means for reducing a predeterminate resistance force to be overcome by the boot for release of the boot from the retention jaw in response to a force exerted on said support plate for generating said rocking motion of said support plate about said longitudinal axis, said reducing means further comprising means for moving said latch from said latched position to said unlatched position.

2. A binding according to claim 1, wherein:

said linking device for reducing a predeterminate resistance force comprises means for linking said support plate to a movable element of the binding, said means for linking further comprises means for generating a compensating force to said movable element of the binding in response to sensing said rocking motion of said support plate for reducing said predeterminate resistance force to be overcome by the boot for release of the boot from the retention jaw.

3. A binding according to claim 2, wherein:

said movable element of the binding to which said support plate is linked by said means for linking comprises an element via which said spring exerts an elastic return force on said jaw.

4. A binding according to claim 1, wherein:

said latch is movable a predetermined distance between said latched position and said unlatched position; and said reducing means of said linking device comprises means for displacing said latch an amount less than said predetermined distance.

5. A binding according to claim 1, wherein:

said rocking motion defining means comprises a longitudinally oriented journal axle.

6. A binding according to claim 1, wherein said linking device further comprises:

a pivotal element and means for journalling said pivotal element about a horizontal axis fixed with respect to said body, said pivotal element comprising at least one arm; and a pusher which engages with said arm of said pivotal element, and means for guiding said pusher for translational movement against said arm.

7. A binding according to claim 6, wherein said linking device further comprises:

a tipping element and means for journalling said tipping element about a horizontal axis fixed with respect to said base, said tipping element comprising:

two lugs in engagement with a lower edge portion of said support plate; and a downwardly extending arm in engagement with said pusher.

8. A binding according to claim 6, wherein:

said pusher comprises means for moving said latch to said unlatched position.

9. A binding according to claim 8, further comprising:

means for guiding said latch with respect to said body and for transmitting said translational movement of said pusher to said arm of said pivotal element.

10. A binding according to claim 9, further comprising:

a pivot fixedly connected to said body, said pivot having a vertically depending external wall and an internal central recess defined by at least one vertically extending wall, said pivotal element being at least partially housed within said central recess of said pivot, and said latch being guided through said wall of said pivot.

11. A binding according to claim 10, wherein:

said base comprises a guide opening within which said pivot is guided for pivoting about an upward extending axis, said guide opening further comprising a recess for partially housing said latch.

12. A binding according to claim 11, wherein:

said latch is substantially anchor-shaped, including a branch curving in a direction substantially around said upstanding axis of said pivot and a body extending from said branch radially toward said upstanding axis, said body being in engagement with said arm of said pivotal element, and said branch being in engagement with said pusher.

* * * * *